United States Patent [19]

Aoki et al.

[11] Patent Number: 4,827,251

[45] Date of Patent: May 2, 1989

[54] DISPLAY CONTROL SYSTEM WITH CONTROL OF BACKGROUND LUMINANCE OR COLOR DATA

[75] Inventors: Hiroshi Aoki, Yokohama; Kenichi Naka, Yamato, both of Japan

[73] Assignee: Panafacom Limited, Yamato, Japan

[21] Appl. No.: 8,316

[22] Filed: Jan. 29, 1987

[51] Int. Cl.[4] ..... G09G 1/28

[52] U.S. Cl. ..... 340/729; 340/703; 340/734; 358/22

[58] Field of Search ..... 340/730, 734, 745, 747, 340/748, 721, 701, 703, 729; 358/22, 903

[56] References Cited

U.S. PATENT DOCUMENTS

| | | | |
|---|---|---|---|
| 3,911,418 | 10/1975 | Takeda | 340/730 |
| 4,149,152 | 4/1979 | Russo | 340/703 |
| 4,360,831 | 11/1982 | Kellar | 340/730 |
| 4,396,939 | 8/1983 | Kitahama | 358/22 |
| 4,420,770 | 12/1983 | Rahman | 358/22 |
| 4,437,092 | 3/1984 | Dean et al. | 340/730 |
| 4,451,840 | 5/1984 | Shanley, II | 358/22 |
| 4,470,042 | 9/1984 | Barnich et âl. | 340/745 |
| 4,490,979 | 12/1984 | Staggs et al. | 340/721 |
| 4,684,935 | 8/1987 | Fujisaku et al. | 340/745 |
| 4,698,666 | 10/1987 | Lake, Jr. et al. | 340/730 |
| 4,710,761 | 12/1987 | Kapur et al. | 340/721 |

*Primary Examiner*—John W. Caldwell, Sr.
*Assistant Examiner*—Edwin C. Holloway, III
*Attorney, Agent, or Firm*—Staas & Halsey

[57] ABSTRACT

A display control system with a control of background luminance or color data applicable for a personal computer with a paper-white type display device includes a character video signal generation unit, a background luminance setting register, a video enable signal generation unit, a video signal priority unit, and a video signal synthesis unit. A first video enable signal from the video enable signal generation unit controls the supply of the video signals to the video signal priority unit. A second video enable signal from the video enable signal generation unit controls a display of background in a background luminance tone or color designated by the background luminance setting register for an intermediate range when the character video signal is absent.

2 Claims, 8 Drawing Sheets

DISPLAY PLANE

| Fig. 3 A | Fig. 3 B |
|---|---|

STRUCTURE OF VIDEO SIGNAL PRIORITY CIRCUIT

| S'' (CV) INPUT | S'' (GV) INPUT | S (CV) OUTPUT | S (GV) OUTPUT | S (BL) OUTPUT |
|---|---|---|---|---|
| 0 | 0 | 0 | 0 | 1 |
| 0 | 1 | 0 | 1 | 0 |
| 1 | 0 | 1 | 0 | 0 |
| 1 | 1 | 1 | 0 | 0 |

VIDEO ENABLE SIGNALS

DISPLAY CONTROL SYSTEM WITH CONTROL OF BACKGROUND LUMINANCE OR COLOR DATA

BACKGROUND OF THE INVENTION

1. Field of the Invention

The present invention relates to a display control system with a control of background luminance and color. The system according to the present invention is used, for example, for a display control in a personal computer.

2. Description of the Related Arts

In a prior art display control system, for example, of the paper-white display type, a character pattern video signal, a character video red signal, a character video green signal, a character video blue signal, a character video intensity signal, a graphic video red signal, a graphic video green signal, a graphic video blue signal, and a graphic video intensity signal are used.

The priority between a character video selection signal and a graphic video selection signal is determined by a video signal priority circuit.

The synthesis of the video signal is carried out in a video signal synthesis portion on the basis of the character video selection signal and the graphic video selection signal with the determined priority and a video enable signal generated in a video enable signal generation circuit. The output of the video signal synthesis portion is supplied to a cathode ray tube as a display device.

In order to form a background having a selectable luminance tone or a selectable color on a display plane of the display device in the prior art system, it is necessary to form such a background either by inverting the signal for the character or by constituting the background from the graphic video red, green, blue, and intensity signals.

However, in the prior art system, a problem arises in that the adjustment of the background luminance tone or the background color is difficult to adequately attain. Also, there is a problem in that the viewing of a character becomes difficult when the position of the character is on the border between the picture range and the edge range, since an edge of the character which is displayed in black color continues into the same black color of the edge range on the display plane, so that discrimination of the character from the edge range on the display plane becomes difficult.

SUMMARY OF THE INVENTION

It is an object of the present invention to provide an improved display control system with a control of background luminance or color data in which the adjustment of the background luminance tone or the background color is carried out satisfactorily, and to eliminate the difficulty in the discrimination of the character from the edge range on the display plane.

According to the present invention, there is provided a display control system with a control of background luminance or color data including: a character video signal generation unit for generating a character video signal and character video luminance or color signals; a video signal synthesis unit for synthesizing a resultant video signal from a plurality of video signals; a display unit for display using the resultant video signal; a background luminance setting register for setting background luminance data or color data; a video signal priority unit for determining a priority between a plurality of video signals to produce a priority selected video signal; and a video enable signal generation means for generating a first video enable signal for a character video signal generated from the character video signal generation unit and a second video enable signal for the background luminance signal or the color signal. The video signal synthesis unit synthesizes the generated character video signal, character video luminance or color signals, and background luminance or color data from the background luminance setting register. The first video enable signal controls the supply of the generated video signals to the video signal priority unit, and the second video enable signal controls a display of background in a background luminance tone or color designated by the background luminance setting register for an intermediate range where the character video signal is absent.

DESCRIPTION OF THE PREFERRED EMBODIMENTS

Figure 1:
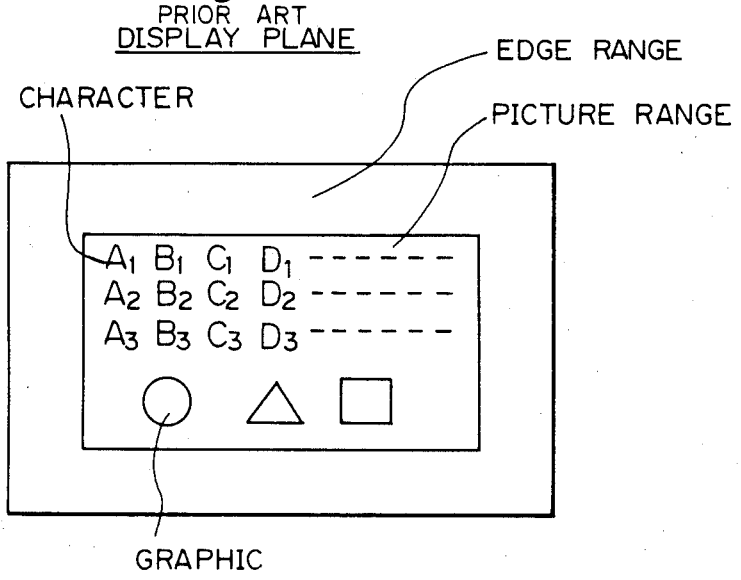
Fig. 1 PRIOR ART
FIG. 1 shows an example of the display on the display plane of the display device in a prior art display system.
Figure 2:
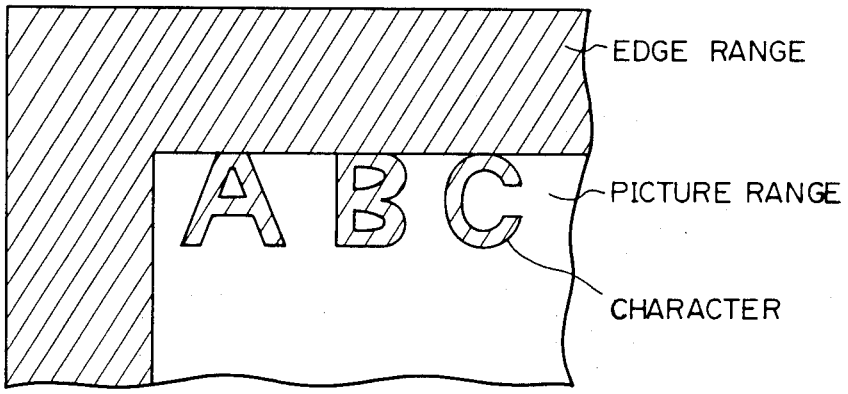
Fig. 2 PRIOR ART
FIG. 2 shows the state of continuation of a character into the edge range in the display plane of FIG. 1.

Before describing the preferred embodiments of the present invention, a prior art display control system of the paper-white display type is described with reference to FIGS. 1, 2, and 3. The paper-white type of display has been regarded as recommendable from the viewpoint of ergonomics. In FIG. 1, an example of the display on the CRT display plane of the prior art display device is shown. The character picture such as $A_1$, $B_1$, $C_1$, $D_1$—or the like, and the graphic picture such as a circle, a triangle, a rectangle, or the like are displayed in the picture range. The edge range is provided around the picture range. In the display system of the paper-white type, the character picture and the graphic picture are displayed in black or another color, the background in the picture range is displayed in white, and the edge range is displayed in black or another color. The continuation of an edge of a black character and the black edge range is illustrated in FIG. 2, which shows an enlargement of the display of FIG. 1.

Figures 3, 3A:
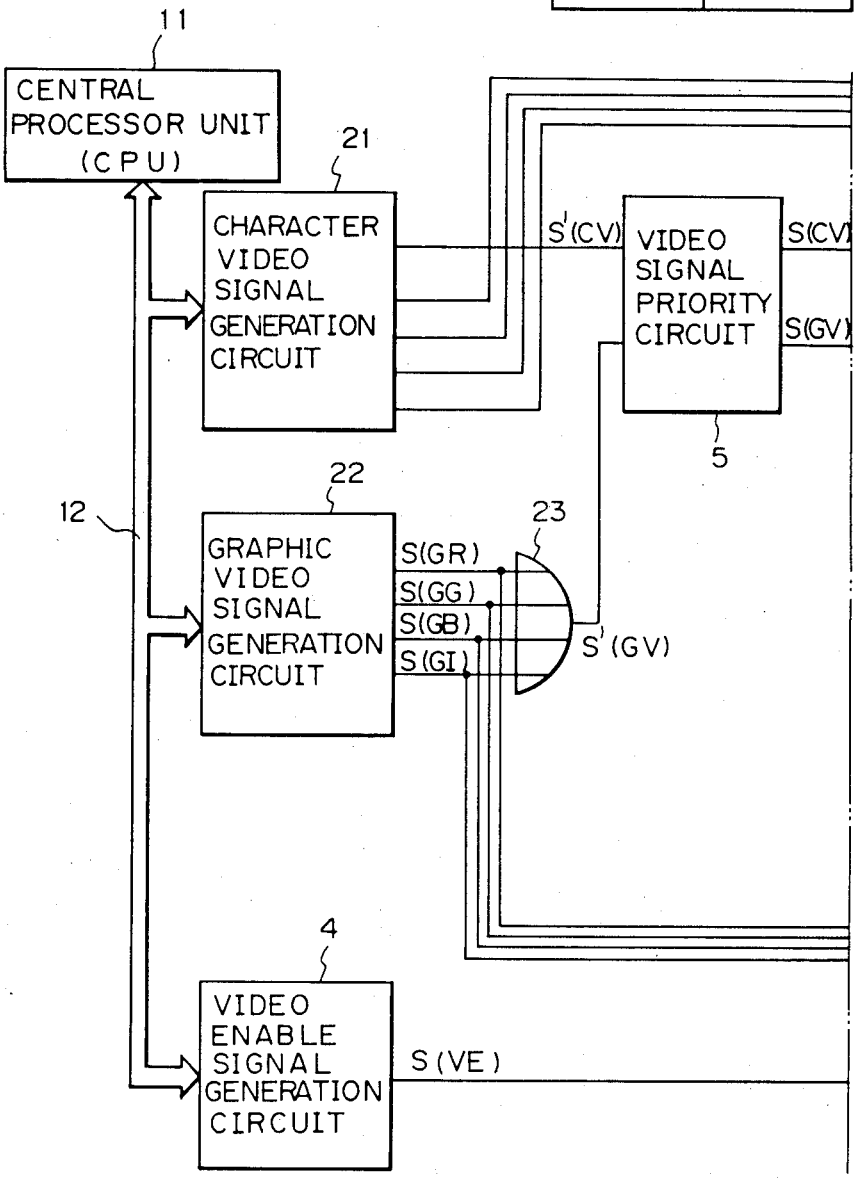
Fig. 3A PRIOR ART
FIG. 3A shows 3B a prior art display control system.
Figure 3B:
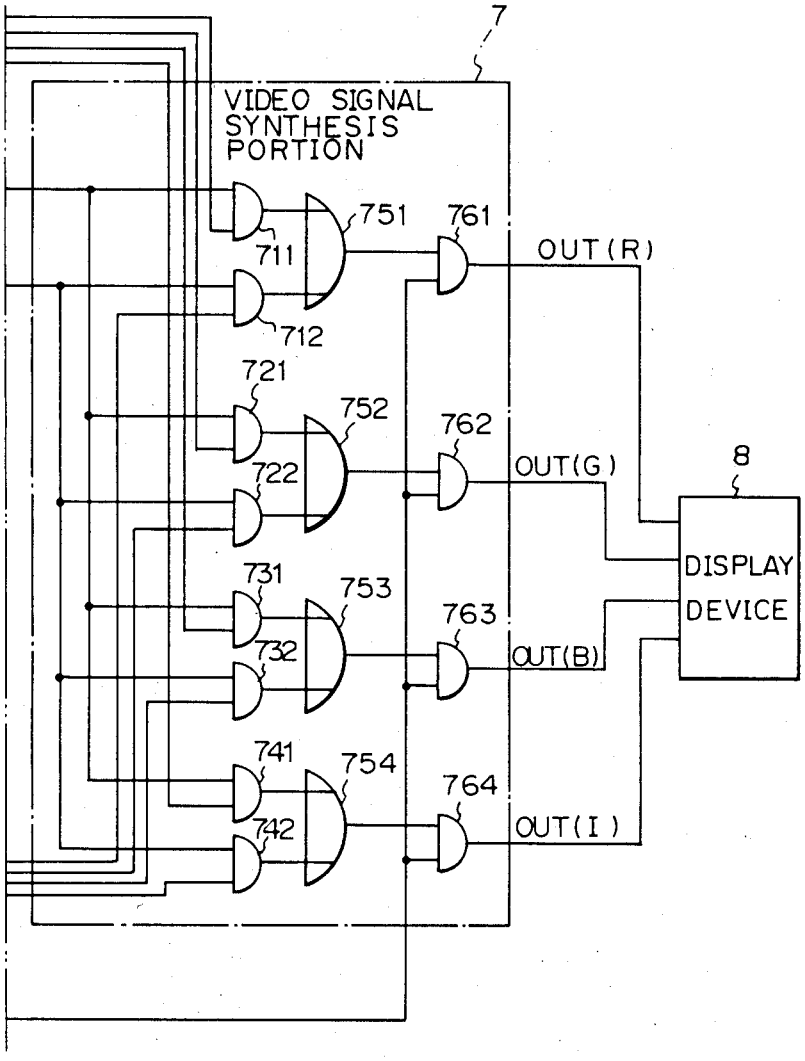
Fig. 3B PRIOR ART

As shown in FIG. 3, the display control system of the prior art includes a central processor unit 11, a data bus 12, a character video signal generation circuit 21, a graphic video signal generation circuit 22, a video enable signal generation circuit 4, a video signal priority circuit 5, a video signal synthesis portion 7, and a display device 8.

In the case of a monochrome display method, for example, 16 luminance tones are used, and in the case of a color display method, for example, 16 colors are used.

The character video signal generation circuit 21 delivers a character video signal S(CV), a character video (luminance) red signal S(CR), a character video (luminance) green signal S(CG), a character video (luminance) blue signal S(CB), and a character video (luminance) intensity signal S(CI).

The character video signal S'(CV) is "1", or "0", generated in synchronization with the cycle period of video clock signals. The character video red, green, blue, and intensity signals are changeable with at least one character unit.

The graphic video signal generation circuit 22 delivers a graphic video (luminance) red signal S(GR), a graphic video (luminance) green signal S(GG), a graphic video (luminance) blue signal S(GB), and a graphic video (luminance) intensity signal S(GI). The timing of the generation of the signals S(GR), S(GG), S(GB), and S(GI) is the same as the timing of the generation of the signal S'(CV).

The signals S(GR), S(GG), S(GB), and S(GI) from the graphic video signal generation circuit 22 are supplied to an OR gate 23 which delivers a graphic video signal S'(GV).

The signal S'(CV) from the character video signal generation circuit 21 and the signal S'(GV) from the OR gate are supplied to a video signal priority circuit 5 which delivers a character video selection signal S(CV) and a graphic video selection signal S(GV) with the determined priority. The determination of priority in the video signal priority circuit 5 is carried out either by hardware or by software. Usually the priority is given to the character video selection signal S(CV) over the graphic video selection signal S(GV).

The signals S(CV) and S(GV) from the video signal priority circuit 5, the signals S(CR), S(CG), S(CB), and S(CI) from the character video signal generation circuit 21, and a video enable signal S(VE) from the video enable signal generation circuit 4 are supplied to the video signal synthesis portion 7. In the video signal synthesis portion 7, logical operations on the basis of input signals are carried out by a group of AND gates 711, 712, 721, 722, 731, 732, 741, and 742, a group of OR gates 751, 752, 753, and 754, and a group of AND gates 761, 762, 763, and 764.

The output signals OUT(R), OUT(G), OUT(B), and OUT(I) are supplied to a cathode ray tube 8 as the display device.

In the horizontal scanning, usually the duration of the signal S(VE) is shorter than the horizontal scanning period of a raster. In the vertical scanning, usually the duration of the signal S(VE) is shorter than the vertical scanning period of a raster. During the period when the signal S(VE) is "1", the signals OUT(R), OUT(G), OUT(B), and OUT(I) are delivered, and during the period when the signal S(VE) is "0", the signals OUT(R), OUT(G), OUT(B), and OUT(I) are masked so that a display of black is carried out.

In the system of FIG. 3, the signals OUT(R), OUT(G), OUT(B), and OUT(I) correspond to colors red(R), green(G), blue(B), and light intensity (I). By using 4 bits of OUT(R), OUT(G), OUT(B), and OUT(I), a display with 16 tones for the monochrome representation or a display with 16 colors for the color representation is carried out.

Figure 4A:
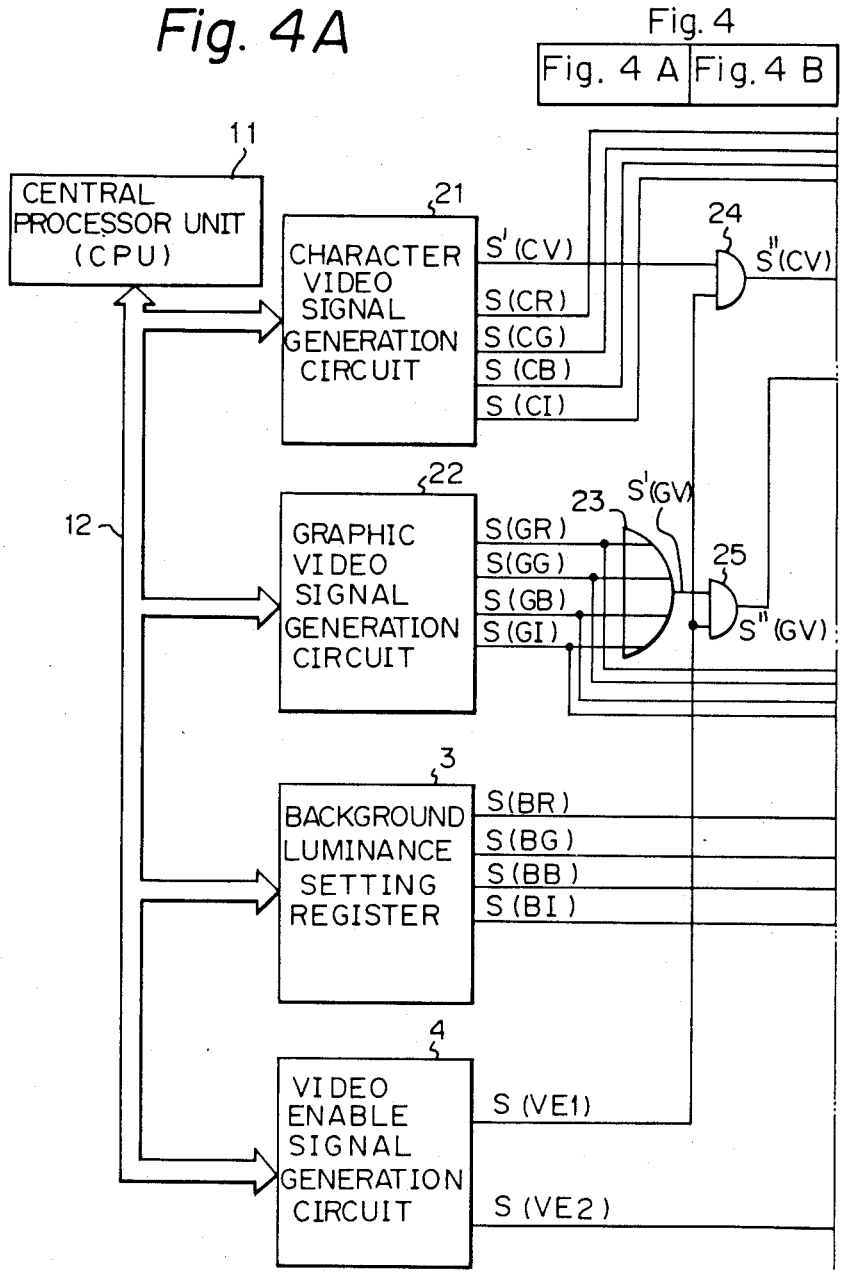
FIG. 4A and 4B is a schematic diagram of a display control system with a control of background luminance or color data.
Figure 4B:
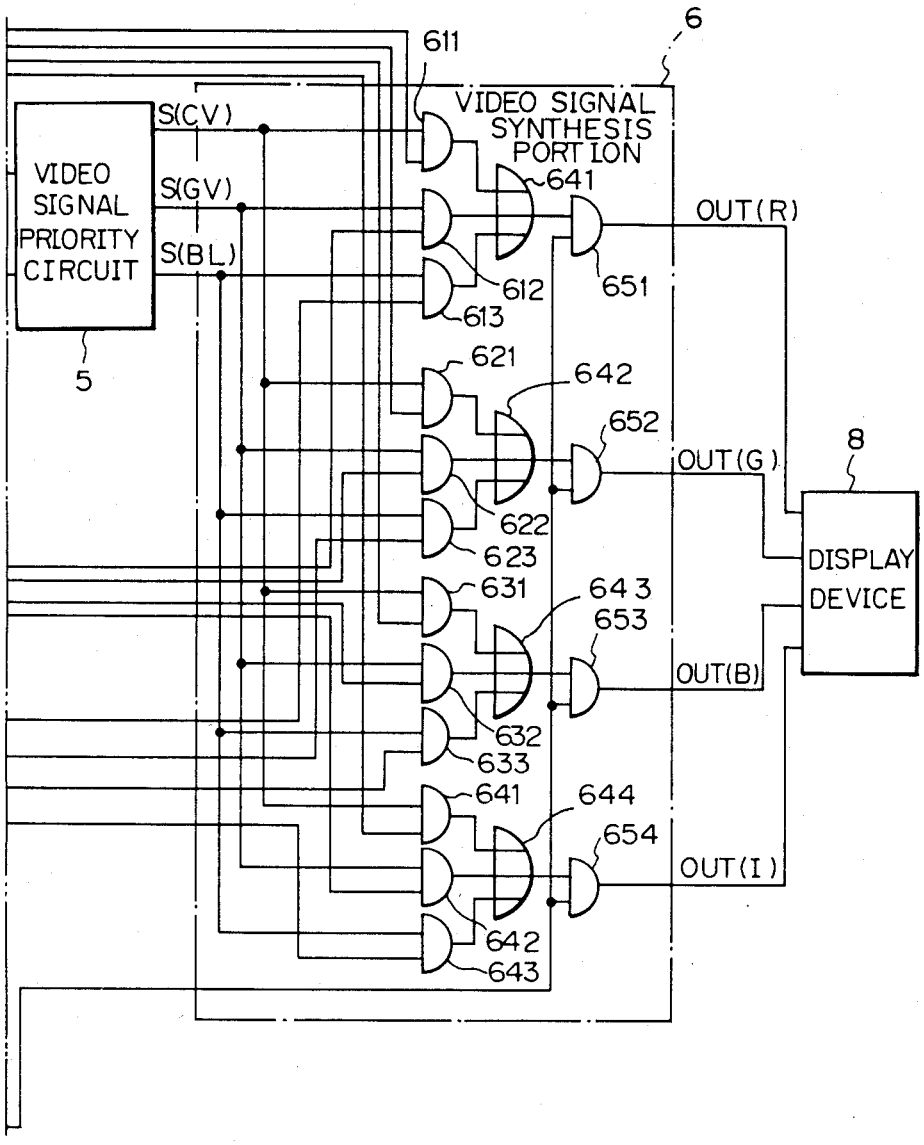

A display control system according to a preferred embodiment of the present invention is shown in FIG. 4.

The character video signal generation circuit 21, the graphic video signal generation circuit 22, the background luminance setting register 3, and the video enable signal generation circuit 4 are connected, via the data bus 12, with the central processor unit (CPU) 11.

The character video signal S'(CV) from the circuit 21 is supplied to one input terminal of the AND gate 24; the graphic video red, green, blue, and intensity signals S(GR), S(GG), S(GB), and S(GI) from the circuit 22 are supplied to the input terminals of the OR gate 23; and the graphic video signal S'(GV) from the OR gate 23 is supplied to one input terminal of the AND gate 25.

The first video enable signal S(VE1) from the video enable signal generation circuit 4 is supplied to another input terminal of the AND gates 24 and 25.

The character video signal S''(CV) from the AND gate 24 and the graphic video signal S''(GV) from the AND gate 25 are supplied to the input terminals of the video signal priority circuit 5.

In the video signal priority circuit 5, a priority determination is carried out between the supplied signals, and the character video selection signal S(CV), the graphic video selection signal S(GV), and the background lumination selection signal S(BL) are delivered from the video signal priority circuit 5 with the designation of sequence of priority for each of the signals S(CV), S(GV), and S(SBL).

The determination of priority in the video signal priority circuit 5 is carried out either by hardware or by software. Usually the priority is given to the character video selection signal S(CV) over the graphic video selection signal S(GV).

Figures 5, 6:
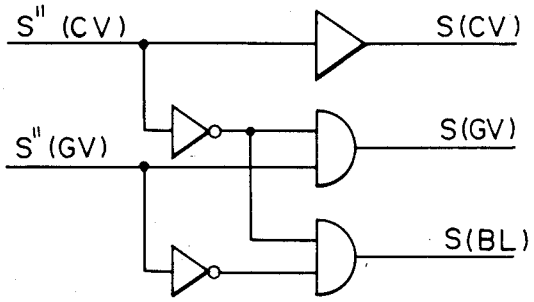
FIG. 5 shows an example of the structure of the video signal priority circuit in the system of FIG. 4.
FIG. 6 is the truth value list for the circuit of FIG. 5.

An example of the structure of the video signal priority circuit 5 is shown in FIG. 5. The truth value list for the circuit of FIG. 5 is shown in FIG. 6.

In the truth value list of FIG. 6, the highest priority is attributed to the signal S(CV), the next highest to the signal S(GV), and the lowest priority to the signal S(BL). Accordingly, the background luminance selection signal S(BL) is delivered only when neither the character video selection signal S(CV) nor the graphic video selection signal S(GV) exists.

The video signal synthesis portion 6 includes a group of AND gates 611, 612, 613; 621, 622, 623; 631, 632, 633; 641, 642, 643; a group of OR gates 641, 642, 643, and 644, and a group of AND gates 651, 652, 653, and 654.

The signal S(CV) from the circuit 5 is supplied to the first input terminals of the AND gates 611, 621, 631, and 641. The signal S(GV) from the circuit 5 is supplied to the first input terminals of the AND gates 612, 622, 632, and 642. The signal S(BL) from the circuit 5 is supplied to the first input terminals of the AND gates 613, 623, 633, and 643.

The character video red, green, blue, and intensity signals S(CR), S(CG), S(CB), and S(CI) from the circuit 21 are supplied to the second input terminals of the AND gates 611, 621, 631, and 641, respectively and the graphic video red, green, blue, and intensity signals S(GR), S(GG), S(GB), and S(GI) are supplied to the second input terminals of the AND gates 612, 622, 632, and 642, respectively.

The background luminance red, green, blue, and intensity signals S(BR), S(BG), S(BB), and S(BI) from the background luminance setting register 3 are supplied to the second input terminals of the AND gates 613, 623, 633, and 643, respectively.

The first video enable signal S(VE1) for character video signal and the second video enable signal S(VE2) for background luminance signal are delivered from the video enable signal generation circuit 4. The first video enable signal S(VE1) is supplied to the second input terminals of the AND gates 24 and 25, and the second video enable signal S(VE2) is supplied to the second input terminals of the AND gates 651, 652, 653, and 654.

The output OUT(R) of the AND gate 651, the output OUT(G) of the AND gate 652, the output OUT(B) of the AND gate 653, and the output OUT(I) of the AND gate 654 are supplied to a cathode ray tube 8 as the display device.

In the system of FIG. 4, only when both the character video selection signal S(CV) and the graphic video selection signal S(GV) are "0", i.e., when there is no information to be displayed on the display device 8, does the background luminance selection signal S(BL) become active, so that the field having a background luminance or background color provided on the basis of the background luminance signals S(BR), S(BG), S(BB) and S(BI) from the background luminance setting register 3 is displayed on the display device 8.

Figure 7:
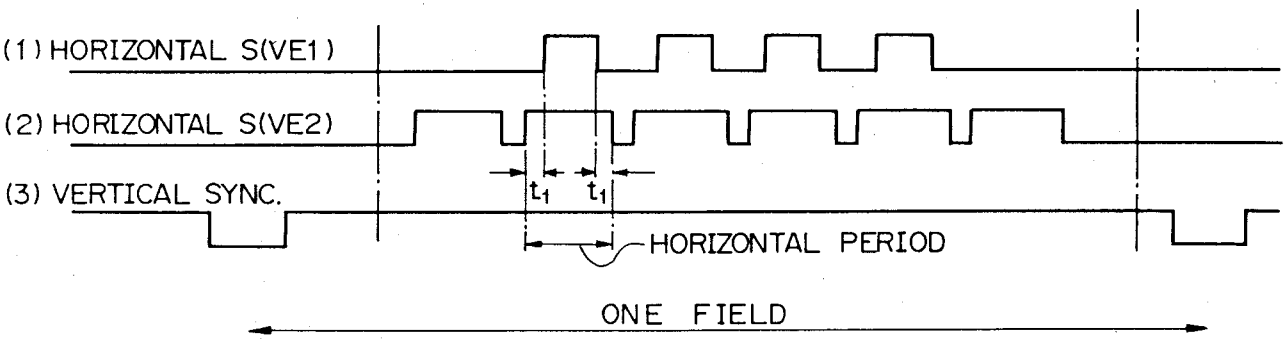
FIG. 7 shows the waveforms of the video enable signals appearing in the system of FIG. 4.

The first video enable signal S(VE1) and the second video enable signal S(VE2) are produced with a timing relationship as illustrated in the waveforms (1) and (2) in FIG. 7.

As shown in FIG. 7, during one horizontal scan, the active period of the signal S(VE2) is longer than the active period of the signal S(VE1).

Similarly, during one vertical scan, the active period of the signal S(VE2) is the same as or longer than the active period of the signal S(VE1).

Due to the operation of the AND gates 24 and 25 (FIG. 4), the character video signal S''(CV) and the graphic video signal S''(GV) are active during the period when the signal S(VE1) is "1", and masked during the period when the signal S(VE1) is "0".

Similarly, the outputs OUT(R), OUT(G), OUT(B), and OUT(I) are delivered from the AND gates 651, 652, and 653 under the control of the signal S(VE2).

The signal S(VE1) is selected so that the signal is "1" during the dot indication span in horizontal and vertical directions prescribed by the display specification for a display device.

The signal S(VE2) is selected so that the period of "1" of the signal is as long as possible without the occurrence of back-raster. The nature of the signal S(VE2) depends on the capability of the display device 8.

Figure 8:
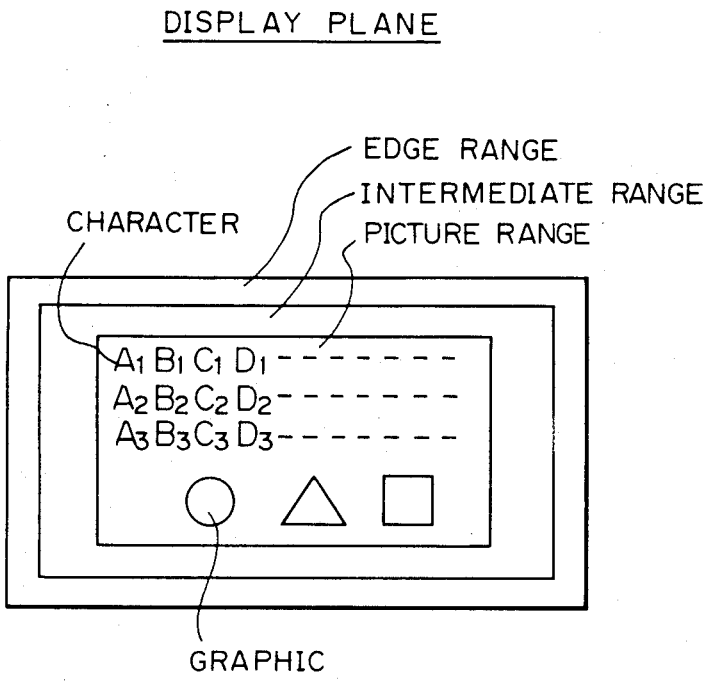
FIG. 8 shows an example of the display on the display plane of the display device in the system of FIG. 4.

As shown in FIG. 7, there are the periods "$t_1$" where both the character video signal S'(CV) and the graphic video signals S(GR), S(GG), S(GB), and S(GI) are masked, since the period of "1" is longer in the signal S(VE2) than in the signal S(VE1). The background luminance selection signal S(BL) is delivered during the periods "$t_1$". Hence, the field having a background luminance or background color is displayed on the display device 8 during the periods "$t_1$", and accordingly, an intermediate range is formed on the display plane between the edge range and the picture range, as shown in FIG. 8.

Therefore, the background luminance indication range is always greater than the picture range for character and graphic indications so that the undesirable continuation of an edge of a displayed character into the dark range, as shown in FIG. 2, is prevented.

In the system of FIG. 4, the background luminance or background color on the display plane can be freely and satisfactorily adjusted, and the undesirable continuation of character displayed in black color into the edge range having the same black color is prevented.

The refresh-memory method is usually adopted in the system of the present invention, however, it is also possible to use the bit-map method for character display in the system of the present invention. In the bit-map method, a graphic video signal generation circuit for formation of character is used instead of the character video signal generation circuit 21 in FIG. 4.

In the system of the present invention, it is possible to use both a character video signal and a graphic video signal or a character video signal alone for the video signal.

We claim:

1. A display control system with a control of background luminance or color data, comprising:

video signal generation means for generating video signals and video luminance or color signals;

video signal synthesis means for synthesizing a resultant video signal from a first plurality of said video signals;

display means for a display using said resultant video signal;

background luminance setting register means for setting background luminance data or color data;

video signal priority means for determining a priority between some of said video signals to produce a priority selected video signal provided to said video signal synthesis means as one of said first plurality of said video signals;

video enable signal generation means for generating a first video enable signal and supplying said first video enable signal to said video signal priority means and for generating a second video enable signal and supplying said second video enable signal to said video signal synthesis means;

said video signal synthesis means synthesizing said first plurality of said video signal, video luminance or color signals, and background luminance or color data from said background luminance setting register means;

first gate means, coupled between said video enable signal generation means and said video signal priority means, for controlling a supply of said some of said video signals to said video signal priority means based on said first video enable signal; and second gate means, coupled to said video enable signal generation means, for controlling a display of background in a background luminance tome or color designated by said background luminance setting register means for an intermediate range based on said second video enable signal when the first enable signal is absent.

2. A system according to claim 1, wherein said video signal generation means includes:

character video signal generation means for providing character video signals and character video luminance or color signals; and graphic video signal generation means for generating graphic video signals, and wherein, said video signal priority means determines the priority between character video signals from said character video signal generation means and graphic video signals from said graphic video signal generation means, and said graphic video signals from said graphic video signal generation means comprising some of said first plurality of said video signals applied to said video signal synthesis means.

* * * * *

UNITED STATES PATENT AND TRADEMARK OFFICE

CERTIFICATE OF CORRECTION

PATENT NO. : 4,827,251

DATED : May 2, 1989

INVENTOR(S) : Hiroshi Aoki et al

It is certified that error appears in the above-identified patent and that said Letters Patent is hereby corrected as shown below:

Title page insert Foreign Application Priority Data -- January 29, 1986 (JP) Japan.....61-017468 --.

References Cited "4,490,979" should be --4,490,797--.

Signed and Sealed this

Twenty-sixth Day of September, 1989

*Attest:*

DONALD J. QUIGG

*Attesting Officer*

*Commissioner of Patents and Trademarks*